US005134386A

United States Patent [19]

Swanic

[11] Patent Number: 5,134,386

[45] Date of Patent: Jul. 28, 1992

[54] INTRUDER DETECTION SYSTEM AND METHOD

[75] Inventor: Anthony Swanic, Las Vegas, Nev.

[73] Assignee: Arbus Inc., Las Vegas, Nev.

[21] Appl. No.: 648,970

[22] Filed: Jan. 31, 1991

[51] Int. Cl.[5] ..... G08B 13/10; G08B 13/18

[52] U.S. Cl. ..... 340/541; 340/555; 340/556; 340/557; 340/666; 250/227.16; 359/195

[58] Field of Search ..... 340/666, 541, 555, 557, 340/556; 250/227.16, 227.21; 359/195

[56] References Cited

U.S. PATENT DOCUMENTS

| | | | |
|---|---|---|---|
| 4,297,684 | 10/1981 | Butter | 340/557 |
| 4,370,020 | 1/1983 | Davey | 340/666 |
| 4,482,890 | 11/1984 | Forbes et al. | 340/557 |
| 4,488,040 | 12/1984 | Rowe | 250/227.14 |
| 4,493,995 | 1/1985 | Adolfsson et al. | 250/227.21 |
| 4,591,709 | 5/1986 | Koechner et al. | 340/555 |
| 4,670,649 | 6/1987 | Senior et al. | 250/227.21 |
| 4,903,339 | 2/1990 | Solomon | 455/612 |
| 4,965,856 | 10/1990 | Swanic | 455/617 |

*Primary Examiner*—Glen R. Swann, III
*Attorney, Agent, or Firm*—William A. Know

[57] ABSTRACT

A microbend-sensitive optical fiber is embedded in a thin pliable padding and laid under an area to be protected. An amplitude-modulated optical light beam is launched into one end of the fiber. The light beam is recovered from the other end of the optical fiber. The angular phase shift between the launched light beam and the recovered light beam is continuously measured and sampled at desired sample intervals. A change in the measured phase shift between any two sequential sample intervals is indicative of the presence of an intruding entity. The magnitude of the phase shift is a function of the mass of the entity. The pattern of repetitive phase shift differences as a function of time provides an estimate of the dynamic characteristics of the intruding entity.

19 Claims, 1 Drawing Sheet

INTRUDER DETECTION SYSTEM AND METHOD

BACKGROUND OF THE INVENTION

1. Field of the Invention

This invention is concerned with the use of changes in the light-transmission characteristics of optical fibers due to microbending with application to detecting intrusion of a protected area.

2. Discussion of the Prior Art

It is well known that when a coherent light beam is transmitted through a multimode optical fiber, certain characteristics of that light beam are altered when the fiber is disturbed by microbending. Because the optical properties of a fiber are profoundly altered by a mechanical disturbance of the fiber, in some applications, such as in the communication arts, great pains are taken to shield and protect the fiber. On the other hand, that very sensitivity to mechanical disturbance makes an optical fiber a fine candidate for use as an intruder detection sensor.

U.S. Pat. No. 4,297,684 to C. D. Butter teaches the concept of burying an optical fiber under a limited area to be protected. A coherent light beam is directed through a length of the fiber. The output light image is a speckled interference pattern that changes in appearance when the fiber is deformed by an intruder walking thereon. The pattern change indicates the fact that a disturbance has taken place.

In U.S. Pat. No. 4,488,040 to D. H. Howe, a strand of aramid cord is wrapped around an optical fiber. The aramid-wrapped fiber in encased in a sheath of flexible material such as a tetrafluorethylene fluorocarbon resin. When the sheath is squeezed, the aramid cord creates microbends in the fiber. The assembly is buried in the ground. A laser sends a beam of coherent light down the fiber from one end. At the other end, a detector measures the change in polarization of the emerging light beam when the fiber is disturbed. Detection of a change in polarization activates an alarm signal.

H. E. Solomon, in U.S. Pat. No. 4,903,339, teaches a method for detecting intrusion of a communications system. Here, the original data signal includes a synchronizing periodic waveform. The receiver generates an inverted synchronizing waveform that is nulled against the transmitted waveform. When the system is violated, power is extracted from the system so that the nulled condition is disrupted and an alarm signal is set off.

A somewhat similar system is taught by my U.S. Pat. No. 4,965,856 assigned to the assignee of this invention. Here, a reference signal is transmitted from a first location to a second location over an optical-fiber communications link. A replica of the reference signal is transmitted to the second location over a separate communications channel. At the second (receiver) location the phase shift between the reference signal and its replica is measured. An alarm is sounded when the phase shift departs significantly from a specified value.

All of the specimens of known art teach qualitative alarm systems that simply announce the fact that an intrusion has taken place but without making any sort of quantitative judgement of who or what caused the intrusion. It would seem wasteful of resources, for example, to call out the bloodhounds to pursue a stray baseball that happened to land on an intruder-detection array near a prison fence.

It is an object of this invention to provide a smart system for estimating the genus of an entity intruding into a secure area.

SUMMARY OF THE INVENTION

An optical fiber having two ends is sequestered under an area to be protected. An optical carrier signal is amplitude-modulated by a reference signal and is launched into one end of the fiber. The amplitude-modulated optical carrier signal is received from the other end of the optical fiber after passage therethrough. The received amplitude-modulated optical carrier signal is demodulated to recover the reference signal. A phase detector continuously measures the magnitude of the phase shift between the original reference signal and the recovered reference signal. At timed intervals, the phase shift measurements are sampled. The sampled phase shift measurements are stored as a time series with arguments of phase shift magnitude versus sample-interval number. A desired action is initiated when the magnitude of the measured phase shift changes significantly between any two sequential sample intervals. From the magnitude of a change in phase shift, the mass of the intruding entity is estimated. An analysis of the pattern of repetitive phase shift changes as a function of time permits an estimate of dynamic characteristics of interest peculiar to the intruding entity.

BRIEF DESCRIPTION OF THE DRAWINGS

These and other benefits of this invention will be better understood by reference to the appended detailed description of the preferred embodiment and the drawings wherein.

DETAILED DESCRIPTION OF THE PREFERRED EMBODIMENT

Figure 1:
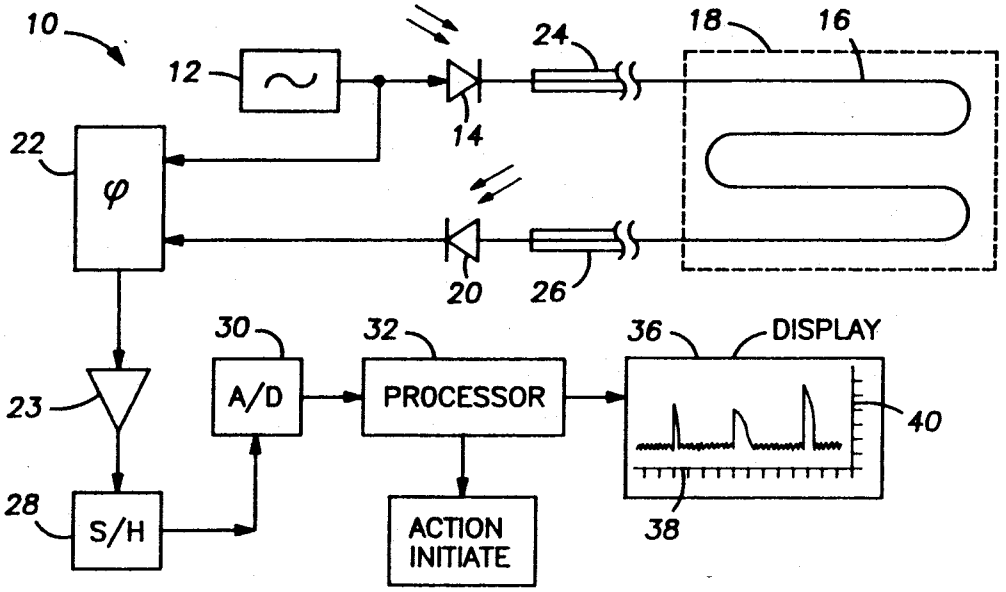
FIG. 1 is a schematic diagram of the configuration of an exemplary intruder detection system.

FIG. 1 is a simplified schematic diagram of the essential components of my smart intruder detection system. It consists of an oscillator 12 that may operate in the 1-1000 MHz frequency range. Other ranges may be selected depending upon the field requirements. The oscillator outputs an original reference signal for amplitude-modulating the optical output of light-emitting diode (LED) 14 which launches the amplitude-modulated optical carrier signal into one end of optical fiber 16. Optical fiber 16 is distributed around a protected area 18 which is outlined by the dashed lines. The other end of optical fiber 16 is coupled to a photodetector 20, such as a PIN diode that detects and demodulates the amplitude modulated optical carrier signal after passage through the optical fiber 16, to recover the reference signal. The received, recovered reference signal is sent to phase detector 22, symbolized by the symbol $\phi$. The original reference signal from oscillator 12 is also sent to phase detector 22. Phase detector 22 measures the phase difference between the original reference signal and the recovered reference signal received through the optical fiber 16.

Before proceeding further, let us consider the arrangement of the optical fiber sensor itself. Between LED 14 and the area to be protected, fiber 16 must be hardened or shielded by a suitable means 24 of any desired type, such as rigid tubing, so that inappropriate events external to the sensor unit will not trigger the system. Similarly, hardening 26 is required between the output end of the fiber and photodetector 20. The remaining connections shown as heavy lines, are wire-line connections.

The configuration of the optical fiber in an area of interest depends upon the size and shape of the area. In a residential room or an office, several meters of fiber may be zig-zagged beneath a carpet or pad with a few centimeters separation between zigs and zags. In an installation laid between a pair of adjacent security fences around a prison, as much as a kilometer of fiber may be laid down and doubled back on itself between the fences with a separation of perhaps five meters between the two portions of the doubled-back strand. A single fiber may be used to monitor an area of 1000 square meters.

Figure 2:
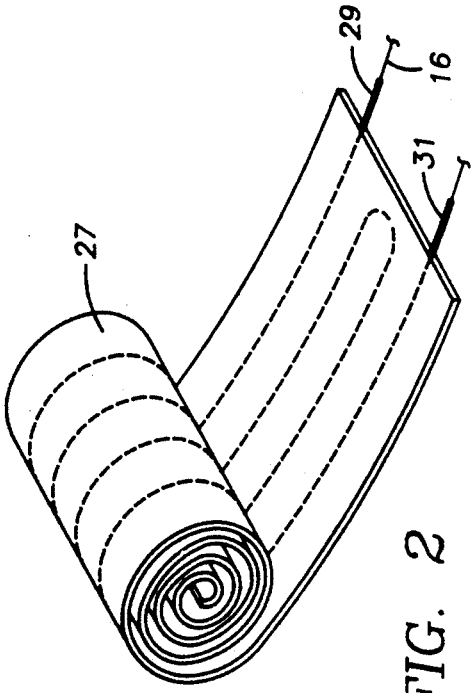
FIG. 2 shows a roll of padding that includes an optical fiber embedded therein.

As pointed out earlier, microbending of an optical fiber will cause a relative phase shift between the input and output optical signals. For practical use, it is necessary to somehow sequester the fiber against detection by an evildoer by hiding the fiber such as by embedding the fiber in a mat. In an office space, the mat could take the form of the resilient carpet pad normally installed under carpeting. In open spaces, the fiber 16 can be molded into a thin flexible matting of suitable weatherproof plastic sheeting, such as polyurethane or teflon. The matting should be sufficiently thin and pliable so that the embedded fiber will suffer microbending when stepped upon or impacted by an entity. The mat may be supplied in long rolls much like carpeting or Astro-turf, as shown as 27 in FIG. 2. External hardened ends 29 and 31 of the fiber 16 would extend beyond the edge of the plastic mat for connection to the circuit of FIG. 1 or for interconnection with other mats. The fiber 16 is arranged in a desired pattern, such as in FIG. 1, within the confines of the mat. For outdoor use, the mat would be unrolled in a shallow trench, covered by a few millimeters or centimeters of native earth. It is preferable that a naked fiber not be buried underground, unprotected, because the rocks and gravel in the dirt would physically cut the fiber instead of merely bending it. For roof protection, the fiber may be incorporated in the roofing material itself or as an underlayment beneath the shingles or tar paper. In practice, the mat may be as small as a Welcome mat at the front door of a home or as large as the roof of a factory.

I prefer to use a low-quality multimode fiber for this application. The term low-quality refers to a fiber that is unsuitable for conventional communication use because of the fiber's sensitivity to microbending. But that characteristic makes it admirably suited for an intruder protection system.

Returning now to the system of FIG. 1, phase detector 22 continuously measures the angular phase shift between the reference signal from oscillator 12 and the recovered reference signal from the output end of fiber 16. A suitable phase detector may be a RPD-1 module as furnished by Mini-Circuits Laboratory of Brooklyn, N.Y. The output of phase detector 22 is preferably an analog voltage proportional to phase shift, for example 2–10 mv/degree phase shift.

In a real-world system, there will always be a relative angular phase shift or bias between the two signals whether the phase shift be zero or some non-zero value. Microseisms and traffic will introduce random phase shift changes or jitter of a few degrees about some average value, represented by an output voltage bias, that remains essentially constant, absent an intrusion. The average level of the ambient jitter, measured as a voltage, determines a threshold level.

In my preferred system the absolute relative phase shift under static conditions is not of importance. The parameter of interest is the magnitude of a change in phase shift, exceeding a predetermined threshold, that may occur between any two points in time due to a dynamic disturbance. Therefore, output signals from the phase detector 22 are fed to an amplifier 23 and thence to sample-and-hold (S/H) module 28 of any well known type. A typical sample interval may be 250 microseconds by way of example but not by way of limitation. The sampled angular phase shift measurements are converted to digital bytes in analog-to-digital (A/D) converter 30 of any well-known type. The discrete digital data samples are then passed to a data processor 32 which may be a conventional computer. The respective digital samples are stored in memory as a time series formatted in an array having as arguments, measured phase shift magnitudes versus sample count. Since the system is in continuous operation and a computer memory has but limited storage capability, it is convenient to store a small data block such as 20 minutes worth of samples for example. As new data are acquired and entered, old data are shifted out. At a sample interval of 250 microseconds, a 20 minute data block would occupy less than five megabytes of memory, a capability within reach of any modest-sized computer. The function of the computer will be described more fully infra.

Figure 3:
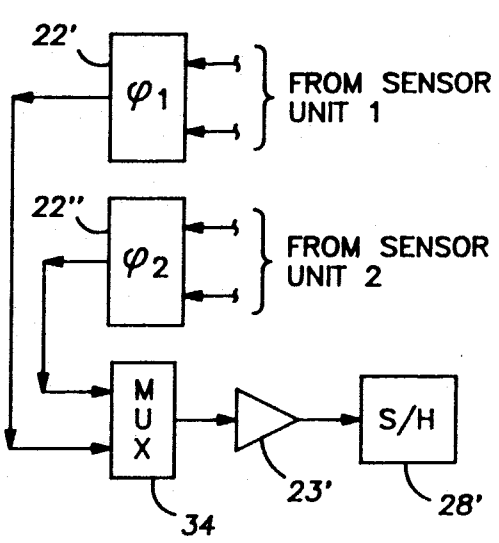
FIG. 3 is a partial diagram of a multiplexed arrangement employing more than one sensor unit.

So far, the system has been disclosed with only a single intrusion detector unit. Referring to FIG. 3 it is of course possible to provide two or more such detector units and corresponding phase detectors 22' and 22''. Data from the two or more units may be multiplexed into a single amplifier 23' and sample-and-hold module 28' by multiplexer 34 and thence directed to the A/D converter and the computer (not shown in FIG. 3). In FIG. 3, only the multiplexer concept is shown to avoid duplication and complication of the drawings. The use of a multiplexer is indicated for those installations where it would be preferable to provide a plurality of adjacent sensor units, each covering a relatively small area, rather than one large-area sensor unit. By that means, the progress of an intruding entity can be tracked within the protected region.

Returning again to FIG. 1, computer 32 is programmed to monitor and evaluate the average level of the random phase shift jitter under static conditions to determine a threshold value. Since the ambient noise level may change with time, the computer constantly updates that threshold. The computer looks for any significant change in the magnitude of the measured phase shift that exceeds the predetermined threshold between any two sequential samples (but not necessarily adjacent samples). A definition of the term "significant change" necessarily depends upon the ambient noise level. By way of example but not by way of limitation, a change in the measured phase shift of more than five to ten degrees might be considered significant. When such a change is detected, a desired action is initiated. That action may be to sound an alarm, close a gate, turn on a floodlight or open a trap door to entrap a potential malefactor or even to trap game animals.

It is of interest to estimate certain characteristics of an intruding entity. From the magnitude of a change in the measured phase shift, the physical mass of an entity may be estimated. I have found that the change in phase shift is directly proportional to mass, such as 1-2 degrees/kg by way of example but not by way of limitation, depending, of course, on the type of fiber, the mechanical elastic constants of the mat or padding and the frequency of oscillator 12. At a lower oscillator frequency, the rate of change of phase shift in degrees per unit of mass is less than at a higher frequency. The frequency of oscillator 12 will be chosen in accordance with the characteristics of anticipated intruders. Thus, the system can distinguish between a small animal, a man walking or a bulldozer simply by reason of the difference in weight as estimated from the magnitude of a measured phase shift sample.

When the computer detects a significant change in measured phase shift, the computer may be programmed to activate a display device such as a TV monitor or a strip chart recorder 36 to provide hard copy. The display device shows the pattern of repetitive phase shift changes as a function of sample interval, that is, as a function of time, in the form of a time scale recording. The display device 36 provides a time base 38 and a scale 40 of phase shift amplitude. From an analysis of the display, preferably a computer analysis, the guardians of a facility can make a judgement as to appropriate action to be taken.

Figure 4A:
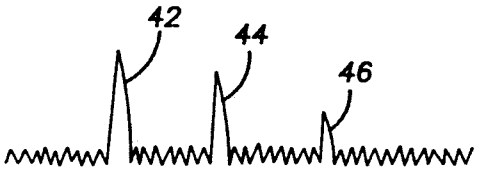
FIGS. 4*a*–4*c* are examples of displays that are postulated to be characteristic of certain genera of intrusive entities.
Figure 4B:
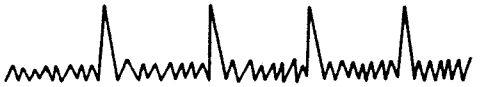
Figure 4C:
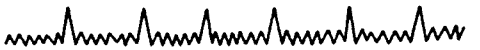

In FIGS. 4*a* to 4*c* I show possible interpretations of repetitive patterns of phase shift anomalies. In FIG. 4*a*, a falling object, such as a rock, might create an initial impact 42 followed by a couple of less forceful bounces 44 and 46. The low-level "grass" along the base line of the trace represents the average ambient noise level or jitter.

A man walking might produce a regular series of peaks having relatively high amplitude such as shown in FIG. 4*b*. A small animal might produce a series of low amplitude impulses at shorter time intervals than those produced by a man, as illustrated in FIG. 4*c*.

I prefer, for calibration purposes, to generate typical test scenarios of people walking or running, dogs running, vehicle operations, falling objects, weather phenomena such as rain and hail, to provide an interpretive reference library similar to the wave trains of FIGS. 4*a*–4*c*. Such a library would provide means for identifying the genus of an intruding entity. The computer would retain that library in memory. By application of well-known cross-correlation processes, the computer would compare the repetitive phase shift patterns as observed in the field, with the respective contents of the reference library to perform the required data analysis. From a stored table of mass with respect to a measured change in phase shift, the computer would identify the bulk of the intruding entity.

The system as here disclosed is exemplary. Those skilled in the art will doubtless conceive of variations in the arrangement of the system and its components but which will fall within the scope and spirit of this teaching which is limited only by the appended claims.

I claim as my invention:

1. A method for detecting an intrusion of a secure area by an entity, comprising:

sequestering at least one optical fiber, having two ends, in an area to be monitored;

amplitude-modulating an optical carrier signal by an original reference signal;

launching said amplitude-modulated optical carrier signal into one end of said optical fiber;

receiving said amplitude-modulated optical carrier signal from the other end of said optical fiber after passage therethrough;

demodulating said received amplitude-modulated optical carrier signal to recover the reference signal;

at preselected timed sampling intervals, measuring the angular phase shift between said original reference signal and the recovered reference signal; and initiating a desired action when the measured phase shift changes by an amount in excess of a predetermined threshold level between any two sequential sample intervals.

2. The method as defined by claim 1, comprising:

estimating the physical mass of an intruding entity from the magnitude of a phase shift change.

3. The method as defined by claim 1, comprising:

storing in a data processor, the phase shift measurements as a time series with arguments of phase shift versus timed sample interval; and analyzing said time series to reveal patterns of repetitive phase shift changes as a function of sample interval thereby to estimate characteristics of interest pertaining to said intruding entity.

4. The method as defined by claim 3, comprising:

displaying said patterns of repetitive phase shift changes as a time scale recording.

5. The method as defined by claim 3, comprising:

providing a reference library in said data processor, the contents of said library including repetitive patterns of phase shift changes over a period of time, characteristic of various genera of intrusive entities;

cross-correlating a revealed pattern of repetitive phase shift changes with the respective contents of said library to identify the genus of an intrusive entity.

6. The method as defined by claim 5, comprising:

disposing a mat of thin pliable plastic sheeting, having an elongated optical fiber embedded therein, under an area to be protected, said optical fiber being arranged in a desired pattern within the confines of said mat.

7. A smart intruder detection system, comprising:

an optical fiber, sensitive to microbending, sequestered in an area to be protected;

oscillator means for providing an original reference signal;

means for amplitude-modulating an optical carrier signal by said original reference signal and for launching the amplitude-modulated optical carrier signal into said optical fiber;

means for receiving said amplitude-modulated optical carrier signal from said optical fiber after passage therethrough;

means for demodulating the received amplitude-modulated optical carrier signal to recover the reference signal;

means for continuously measuring the angular phase shift between said original reference signal and a recovered reference signal;

means for sampling the measured phase shift at timed sampling intervals;

means for initiating a desired action when the sampled phase shift measurements change by an amount in excess of a predetermined threshold level between any two sequential sample intervals.

8. The system as defined by claim 7, comprising:

means for estimating the mass of an intruding entity from the magnitude of a change in the measured phase shift.

9. the system as defined by claim 8, comprising:

means for storing the sampled phase shift measurements as a function of timed sample interval; and means for estimating characteristics of an intruding entity from an analysis of repetitive patterns of phase shift changes as a function of time.

10. The system as defined by claim 9, comprising:

means for displaying the sampled phase shift measurements as a time scale recording.

11. The system as defined by claim 7, comprising:

means for continuously monitoring the level of random phase shift jitter thereby to update the predetermined threshold level.

12. A smart system for detecting intrusion of a secure area, comprising:

an optical fiber disposed over the area;

a source for providing a periodic reference signal;

means for amplitude modulating an optical carrier signal by said periodic reference signal and for launching the amplitude-modulated optical carrier signal into said optical fiber;

means for detecting and demodulating said amplitude-modulated optical carrier signal, after passage through said optical fiber, to recover the reference signal;

means for measuring and sampling, at timed intervals, the angular phase shift between the reference signal and the recovered reference signal; and means for initiating a desired activity when the sampled phase shift measurements change significantly between sequential sample intervals by an amount in excess of a predetermined threshold level.

13. The smart system as defined by claim 12, comprising:

a data processor means for receiving, storing and formatting the sampled phase shift measurements as a time series; and means for displaying portions of said time series as a time scale recording to reveal repetitive patterns of phase shift changes for identifying the genus of an intruding entity.

14. The smart system as defined by claim 13, wherein:

said data processor continuously monitors the average level of phase shift jitter, due to ambient random noise, to update the predetermined threshold level.

15. The smart system as defined by claim 14, comprising:

a thin pliable padding for disposition under a desired area to be protected, the padding having said optical fiber embedded therein; and external hardened means for coupling said embedded optical fiber to said measuring and sampling means.

16. A method for detecting the presence of an intruding entity in a secure area, comprising:

disposing an optical fiber over the area;

amplitude-modulating an optical carrier signal by an original reference signal;

launching said amplitude-modulated optical carrier signal into said optical fiber;

detecting and demodulating said amplitude-modulated optical carrier signal after passage through said optical fiber to recover the reference signal;

measuring the relative angular phase shift difference between the original reference signal and the recovered reference signal; and initiating a desired activity when the measured phase shift difference significantly exceeds a predetermined threshold level.

17. The method as defined by claim 16, comprising:

sampling the continuously-measured phase shift difference at predetermined sample intervals.

18. The method as defined by claim 17, comprising:

storing and formatting the sampled phase shift differences as a time series;

displaying said time series as a time scale recording; and analyzing said time scale recording to reveal patterns of repetitive changes in the magnitude of the sampled phase shift differences between sequential sample intervals.

19. The method as defined by claim 16, comprising:

continuously monitoring the phase shift jitter due to random noise to define and update said predetermined threshold level.

* * * * *